US005682695A

United States Patent [19]

Hoffman

[11] Patent Number: 5,682,695

[45] Date of Patent: Nov. 4, 1997

[54] COMBINATION PRESENTATION ORGANIZER

[76] Inventor: Steven Hoffman, 202 Ethel Ave., Mill Valley, Calif. 94941-2736

[21] Appl. No.: 287,621

[22] Filed: Aug. 8, 1994

[51] Int. Cl.[6] ..... G09F 7/12

[52] U.S. Cl. ..... 40/594; 40/657; 434/429; 434/430; 248/205.2

[58] Field of Search ..... 40/594, 617, 657, 40/661; 434/413, 415, 416, 421, 428, 429, 430; 248/205.2, 205.3; 211/86, 87

[56] References Cited

U.S. PATENT DOCUMENTS

| | | | |
|---|---|---|---|
| 2,914,873 | 12/1959 | Brennan | 40/594 |
| 4,744,189 | 5/1988 | Wilson | 434/430 X |
| 4,756,106 | 7/1988 | Foster | 40/594 X |
| 4,828,502 | 5/1989 | Leahy | 434/421 X |
| 4,893,425 | 1/1990 | Ellis . | |
| 4,930,237 | 6/1990 | Oliphant | 40/617 |
| 4,991,812 | 2/1991 | MacEwan . | |
| 4,991,813 | 2/1991 | Beaulieu . | |
| 5,016,373 | 5/1991 | Theno | 40/617 X |
| 5,056,251 | 10/1991 | Connor et al. | 40/661 |
| 5,099,594 | 3/1992 | Reas et al. | 40/597 X |
| 5,181,742 | 1/1993 | Peng . | |
| 5,294,208 | 3/1994 | Tremmel, Jr. et al. . | |
| 5,360,342 | 11/1994 | Pardner | 434/415 X |
| 5,485,694 | 1/1996 | Goad | 40/661 |

FOREIGN PATENT DOCUMENTS

| | | | |
|---|---|---|---|
| 2031799 | 4/1980 | United Kingdom | 40/657 |

*Primary Examiner*—Brian K. Green
*Attorney, Agent, or Firm*—Ray K. Shahani

[57] ABSTRACT

A combination presentation organizer comprises a central graphic viewing area and attachment system for attachment to a suitable surface or structure such that the apparatus can provide ready visual access and convenient and efficient information storage and retrieval. The device is constructed of a suitable material, such as vinyl, which would be compatible with permanent or nonpermanent water or other solvent based ink markers, adhesive-backed notes, and could be transparent or opaque and of any color. Sized similar to a bulletin board or chalkboard and, optionally, a clipboard or other smaller design, the device can come with marking devices, pointers or notepads. The device is mounted using attachment system integral to the device including mating pieces of hook and loop fastening material, temporary, low-tack or permanent, high-tack adhesive. Multiple embodiments of the device can be used simultaneously and in a coordinated fashion, utilizing various sized panels being placed on top or underneath each other, each panel bearing different information or notes.

9 Claims, 3 Drawing Sheets

COMBINATION PRESENTATION ORGANIZER

BACKGROUND OF THE INVENTION

1. Field of the Invention

The present invention relates to communication and presentation systems such as bulletin boards, easels and display devices in general, and more particularly to a fully adaptable and integrated system for organizing, filing and viewing notes, memos, other visual or graphic information which is either permanently or removably affixed to a wall, clipboard or other structure providing suitable support and providing access for interactive function.

2. Prior Art

U.S. Pat. No. 4,893,425 issued Jan. 16, 1990 to Ellis teaches a portable display board assembly comprising a rigid core with a cloth-type outer covering. This invention does not provide a surface for writing notes directly or a surface for collecting, displaying or otherwise organizing adhesive-backed notes. Nor is it as conveniently transported.

U.S. Pat. No. 4,991,812 issued Feb. 12, 1991 to MacEwan teaches a portable viewing stand for viewing books and other larger items, and is similar to a lectern or other desk or podium supported device. This invention is not suited for displaying notes or other information on a wall, nor is it portable.

U.S. Pat. No. 4,991,813 issued Feb. 12, 1991 to Beaulieu teaches a lightweight portable display support which is three dimensional and free standing and has, optionally, lights built in. This invention does not allow multiple layers of information or paper notes to be viewed simultaneously, nor is it readily mountable upon a wall and suitable for taking and providing notes or other information.

U.S. Pat. No. 5,181,742 issued Jan. 26, 1993 to Peng teaches a combination note and article support device and method which includes a paper sheet with a low-tack adhesive on one side for attaching to a surface and a pouch attached thereto for receiving a plurality of notes or articles therein. This invention does not provide a functionally efficient apparatus for effectively displaying and presenting a plurality of information, especially in a larger format, nor is it an integral, portable note organizer.

U.S. Pat. No. 5,294,208 issued Mar. 15, 1994 to Tremmel, Jr. et al. teaches a notebook-type personal organizer which has a traditional binder, covers and plurality of interdisposed leaves for adaptably storing and viewing a plurality of information, which also has a plurality of pouches or pockets for storing notes or other memoranda, receipts, etc. It does not, however, provide visual access and ease in adding, deleting or modifying pieces of information to a large area which is important in making presentations and serving as a true alternative bulletin board, calendar, scheduler, etc.

It is desirable to provide a wall mountable or smaller, hand carried note organizer which is portable and fully integrated. It is desirable to provide a presentation system which can be carried and moved easily, as well as be compatible and interchangeable with other stored sources of information. It would be desirable to provide educators, professionals, and others with a novel information management system. It would also be desirable to provide a device which would serve as a note pad, bulletin board, display tool, scheduler, specialized information board or other communication system which is portable, adaptable to mounting on different surfaces, available in different sizes, and compatible with existing bulletin boards and note pads and clipboards and other office supplies.

SUMMARY OF THE INVENTION

The present invention relates to a wall mountable or smaller, hand carded note organizer which is portable and fully integrated. It is an improved presentation system which can be carried and moved easily, as well as be compatible and interchangeable with other stored sources of information. It will provide educators, professionals, and others with a novel information management system. It is also a device which will serve as a note pad, bulletin board, display tool, scheduler, specialized information board or other communication system which is portable, adaptable to mounting on different surfaces, available in different sizes, and compatible with existing bulletin boards and note pads and clipboards and other office supplies.

A lightweight and portable combination presentation organizer suitable for taking and storing written notes and adhesive-backed notes, organizing information, presenting information is hereby disclosed, said combination presentation organizer comprising a graphic viewing portion and an attachment means for mounting said combination presentation organizer on a suitable viewing surface or structure. An embodiment of the invention is made of a material suitable for removably mounting adhesive-backed notes and which can be written upon using a non-permanent marking device. An embodiment of the invention may have a graphic viewing portion which is transparent and may have a pre-printed surface providing graphical information. An embodiment of the invention is approximately the size of a bulletin board or the size of a clipboard. An embodiment of the invention has an attachment means comprising hook and loop fastening material or a low-tack, removable adhesive or a high-tack, permanent adhesive or a plurality of mounting tabs.

BRIEF DESCRIPTION OF THE INVENTION

DETAILED DESCRIPTION OF THE PREFERRED EMBODIMENTS

Figure 1:
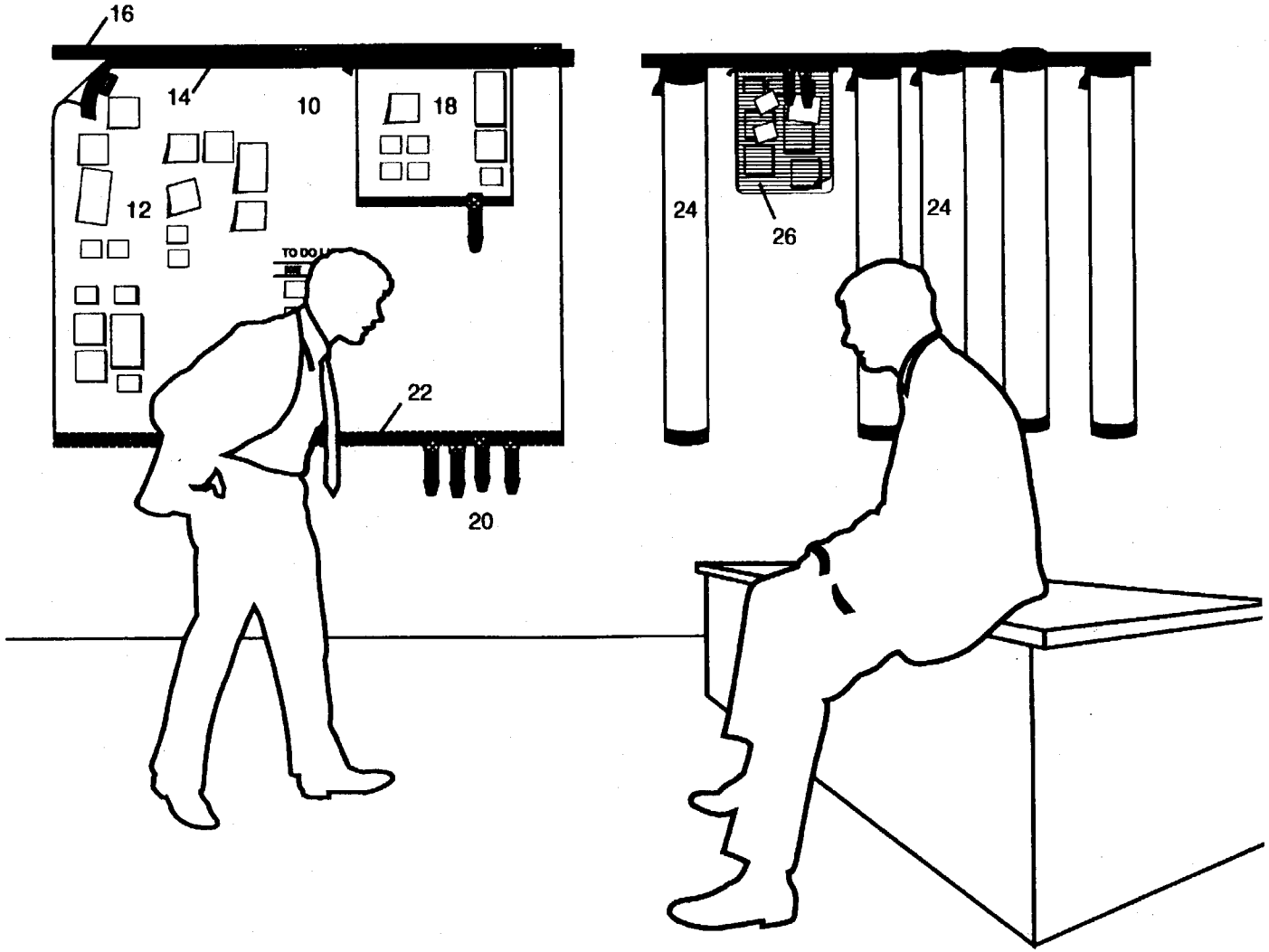
FIG. 1 is a graphical depiction of the present invention.

FIG. 1 is a graphical depiction of the present invention. As shown, in a typical working environment the combination presentation organizer 10 would be mounted on a wall or door. A plurality of adhesive-backed notes 12 can be placed on the surface. The embodiment shown is mounted on the wall by strips of hook and loop fastening material on the panel itself at 14 and on the wall at 16, but can also be attached by other suitable attachment means including pins, hooks, removable or permanent tape, screws, nuts and bolts, rivets, stitching, bonding by chemicals, heat or pressure, or other means known to those skilled in the art. A smaller panel 18 is shown mounted on top of the larger panel using one of the above mentioned attachment means, preferably using hook and loop fastening material. Markers or pointers or other writing or communicating tools 20 can be suspended from the panels at suitable positions as desired by similar attachment means 22. To the right, several rolled panel units 24 are shown hanging on the wall alongside a clipboard size embodiment 26 of the present invention.

Figure 2:
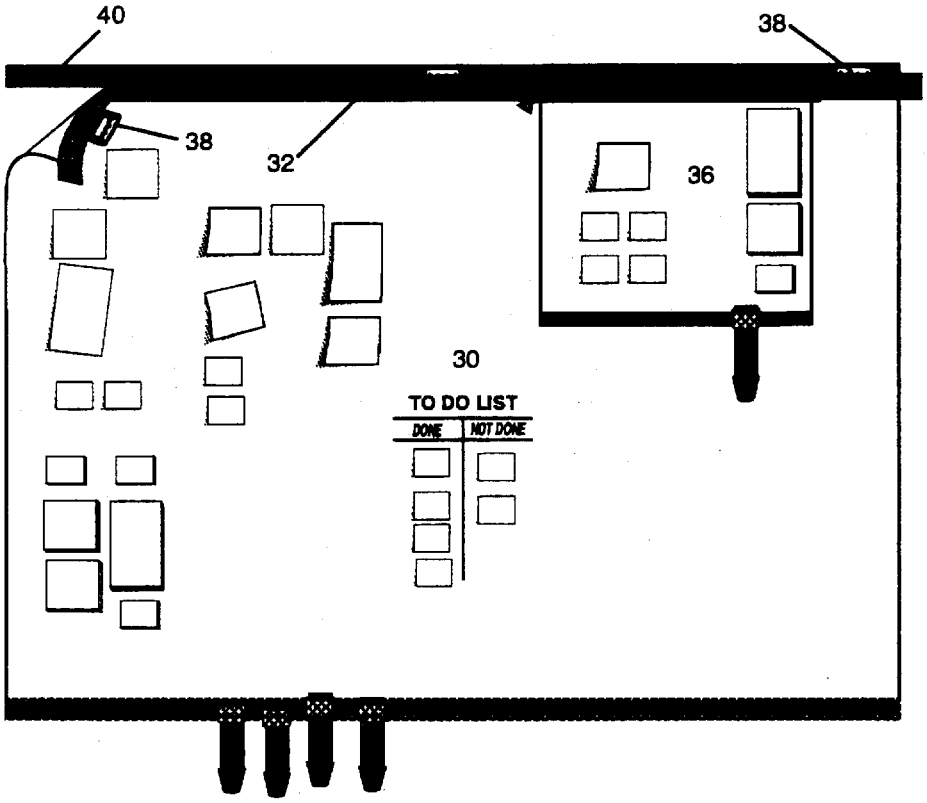
FIG. 2 is a view of the present invention.

FIG. 2 is a view of a large viewing panel of the present invention. As in FIG. 1, adhesive-backed notes can be placed on the front viewing area of the panel. Individual panels can be customized with pre-printed graphics or lettering, as shown at 30. Markers or pointers can be hung from the bottom or other strategic location, as desired. As in FIG. 1, the top edge 32 can be equipped with an attachment means, such as hook and loop connectors, with a matching strip of attaching material 34 placed on the wall. Additionally, a second panel, perhaps smaller in size as shown at 36, but not necessarily, can be placed on top or underneath the primary panel, attached with a piece of hook and loop connecting material or other suitable attachment means. Also shown at points 38 are small mounting eyes for suspending the panel from predetermined positions on a wall or other structure. Additionally, the panel can be equipped with a permanent or removable adhesive strip or other backing on the reverse side of the panel for permanently or temporarily mounting the panel upon any structure desired. Any appropriate materials of construction can be employed for any of the individual components of the system. One suitable material is clear, white or colored polymeric material which is suitable for removably affixing adhesive-backed notes and other materials. A clear plastic or rubber sheet has the added feature of being transparent which increases the utility of the invention by allowing combinations of overlayed information to be viewed and edited more efficiently and simultaneously.

The viewing panel of FIGS. 1 and 2 can be virtually any operable size. As shown, the viewing panel of FIGS. 1 and 2 is approximately the size of a standard bulletin board. It will be understood that bulletin boards come in various sizes, shapes and dimensions. In general, bulletin boards are square or rectangular. While a bulletin board may vary in size between a few inches per side to several feet per side, or even the size of an entire wall of a room, the area of the average bulletin board is typically between 1 and 10 square feet. It will be understood that "the size of a bulletin board" will refer to a size between about 1 and 10 square feet.

Figure 3:
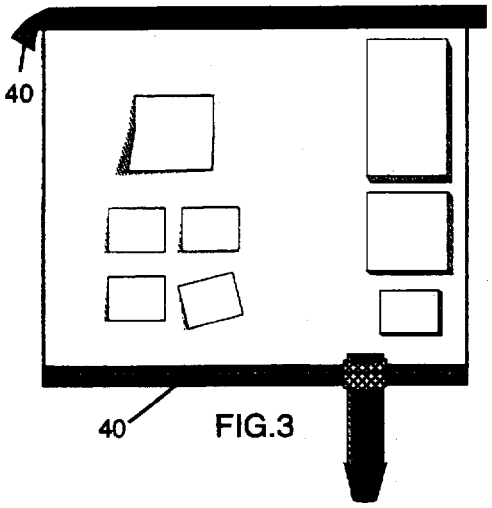
FIG. 3 is a view of an individual viewing panel of the present invention.

FIG. 3 is a view of a small viewing panel of the present invention. As in FIGS. 1 and 2, individual notes and note pads can be placed on the viewing area. Furthermore, attaching strips or other attaching means can be mounted on the top and bottom edges of the panel for attaching the panel to other panels, walls, etc., as well as for hanging markers, pointers, etc. As before, this attaching means can be hook and loop connectors, Tabs 40 can be supplied to provide more convenient mountability or removability of the panel. Any of the panels described herein can also be used for storing and organizing pads of notes. This is especially convenient when notepads of different colors and those bearing different, preprinted information, such as sets of forms for memos, phone messages, receipts, etc.

Figure 4:
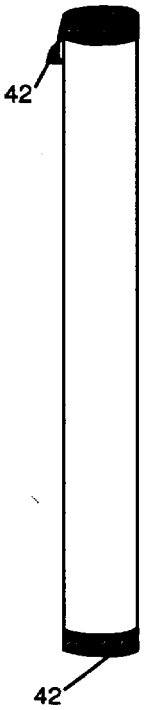
FIG. 4 is a view of the present invention as it would be transported.

FIG. 4 is a view of a rolled panel of the present invention. This method of transportation of the invention is especially convenient when the invention, once rolled, is placed into an adequately sized and shaped tube. Numerous types of map, chart, drawing or other purpose protective tubes are commercially available. Some of these tubes or graphics storage systems have end caps, handles, may be clear or colored, and may be transparent or opaque. The top and bottom edges, or other surfaces, can be conveniently secured using the hook and loop connecting materials or other attachment means 42 mounted on the viewing panels. As shown in FIG. 1, the rolled up panels can individually be hung on a wall or other surface for storage and/or organization.

FIG. 4 shows a rolled panel of the present invention in a storage container for storage and transportation. The storage container is, in a preferred embodiment, tubular and shaped to accommodate the combination presentation organizer of the present invention rolled into a cylindrical shape. The combination presentation organizer of another preferred embodiment can also be folded into other shapes, such as a smaller rectangular or square. In these embodiments, it will be understood that the shape of the storage container would be similarly rectangular or square or other shaped. The storage container can be made of any suitable material or fabric, preferably some type of plastic or other polymeric material, and either opaque or transparent.

Figure 5:
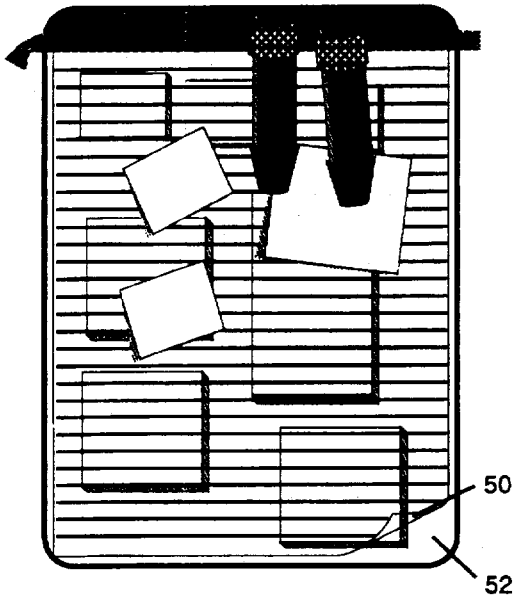
FIG. 5 is a view of a clipboard-size embodiment of the present invention.

FIG. 5 is a view of a clipboard size embodiment of the present invention. In the embodiment shown, a transparent plastic or other polymeric sheet 50 is placed over a rigid panel 52, clear or otherwise, so as to allow simultaneous viewing of the surfaces of both the transparent sheet as well as the rigid panel. In this embodiment, any convenient size or shape of panel can be used. Opaque or colored panels could also be useful to prevent making background information visible. Attachment means can be mounted on the top or bottom edges or other surfaces for attaching the transparent panel to a rigid panel, or for attaching the entire clipboard system to the wall or other bulletin board or organizer. A standard clipboard size can be used to increase compatibility of the system with preprinted forms or regular 8.5×11 inch documents. Optionally, note pads can be mounted on one side with the other side used for organizing notes or other information. Similarly, marking pens can be mounted on the system so as to increase functionality of the portable note taking and organization system. The utility of using multiple layers of plastic sheets is great - this allows one to organize based on different jobs to be performed, notes related to individual meetings or projects, etc. They also provide a convenient way to store information to be transferred to another, larger bulletin board or panel.

The viewing panel of FIG. 3 can be virtually any operable size. As shown, the viewing panel of FIG. 3 is approximately the size of a standard clipboard. It will be understood that clipboards come in various sizes, shapes and dimensions. In general, clipboards are square or rectangular and about 9 inches by 12 inches, perhaps as long as 15 inches to accommodate legal-size paper. While a clipboard may vary in size between a few inches per side to several inches per side, the area of the average clipboard is typically about 9 inches by 12 inches or 9 inches by 15 inches. It will be understood that "the size of a clipboard" will refer to a size about 9 inches by 12 inches or 9 inches by 15 inches.

Figure 6:
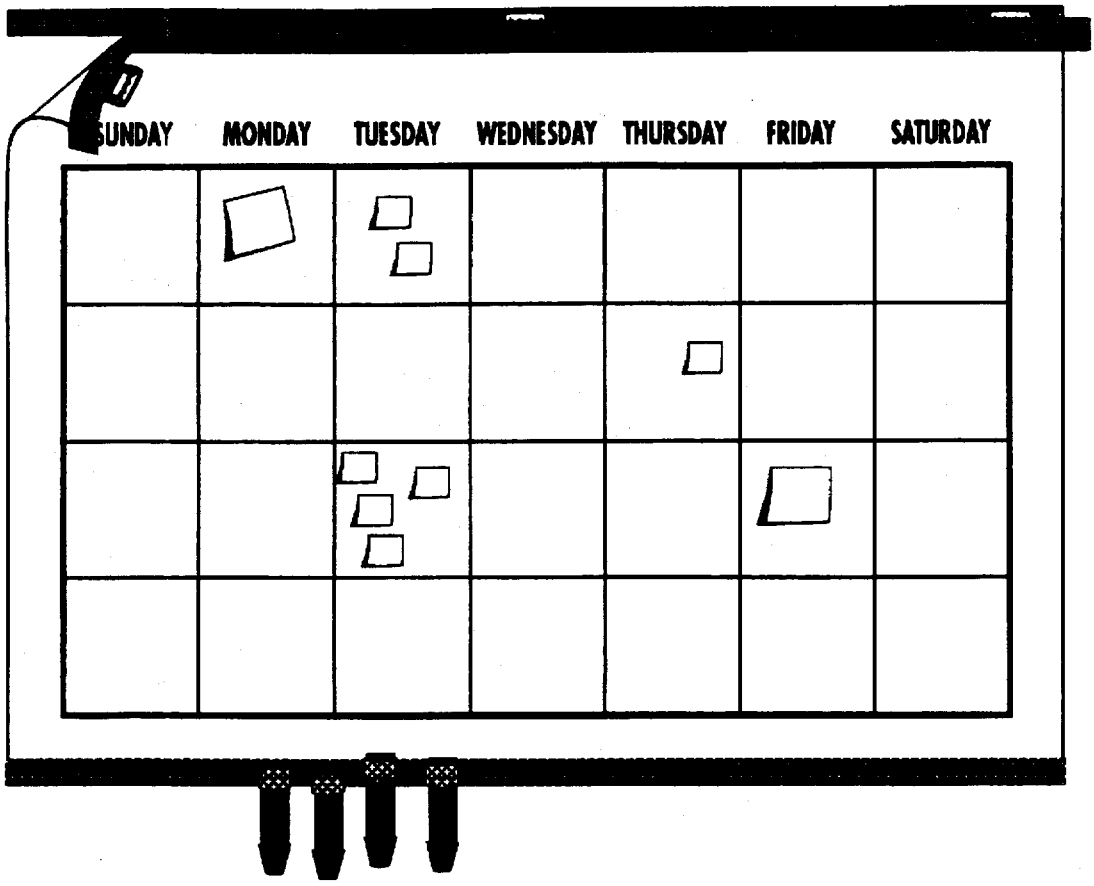
FIG. 6 is a view of a pre-printed panel of the present invention.

FIG. 6 is a view of a pre-printed panel of the present invention. In the embodiment shown, a calendar or other daily record graphic is printed on the front or back of the viewing panel. Other pre-printed patterns might include hourly schedule grids, geographical maps or charts, lines, bull's eye, a yellow brick road, the globe, a solar or stellar system, any decorative motifs or colors or abstract or any other customized pattern desired. As will become evident to the user, the highly adaptable system is very flexible and useful for a wide variety of daily or otherwise routine tasks.

An embodiment of the invention further comprises a plurality of marking or other communicating devices which could use permanent or non-permanent, water or other solvent-based, inks or dyes. An embodiment of the invention further comprises a marking device attachment means for securing said marking devices to said combination presentation organizer. An embodiment of the invention further comprises a container for transporting said combination presentation organizer efficiently and effectively, and optionally said container is tubular shaped.

As will become apparent, the disclosed invention can be produced in different sizes (clipboard, bulletin board, chalk board, refrigerator door or wall, etc.) and colors. The portable organizer is lightweight and it's fully integrated design allows organization and storage of notes, direct marking with permanent or temporary markers, is self contained and is easily mountable, permanently or temporarily. The system is uniquely adaptable for taking notes, leaving messages, brainstorming, giving presentations to one or more individuals or for recording, keeping to-do lists, drawing or sketching, planning, project management or scheduling.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true spirit and scope of the invention.

We claim:

1. A lightweight and portable combination presentation organizer suitable for taking and storing written notes and adhesive-backed notes, organizing information and presenting information, said combination presentation organizer comprising:

a plurality of essentially flat graphic viewing portions made of transparent, flexible material, each of the graphic viewing portions having a front surface and a back surface, each of the graphic viewing portions further having an upper edge and a lower edge, the plurality of graphic viewing portions disposed adjacent each other, one in front of or on top of another, in an essentially planar, stacked, predetermined orientation; and a plurality of attachment means, at least one of the plurality of attachment means for mounting the combination presentation organizer on a suitable viewing surface or structure, at least one of the plurality of attachment means disposed on the front surface of at least one of the graphic viewing portions and at least one of the plurality of attachment means disposed on the rear surface of at least another one of the graphic viewing portions, and each of the plurality of graphic viewing portions attached together by at least one of the plurality of attachment means, the attachment means selected from the group consisting of (1) hook and loop material, (2) low-tack removable adhesive and (3) high-tack, permanent adhesive.

2. The combination presentation organizer of claim 1 wherein said combination presentation organizer is made of a material suitable for use with a non-permanent ink marking device.

3. The combination presentation organizer of claim 1 wherein said plurality of graphic viewing portions have a pre-printed surface providing graphical information.

4. The combination presentation organizer of claim 1 wherein said plurality of attachment means further comprises a plurality of mounting tabs.

5. The combination presentation organizer of claim 1 wherein said plurality of attachment means further comprises a plurality of marking devices.

6. The combination presentation organizer of claim 5 further comprising a marking device attachment means for securing said marking devices to said combination presentation organizer.

7. The combination presentation organizer of claim 1 further comprising a plurality of communication devices.

8. The combination presentation organizer of claim 7 wherein said communication devices include pointers, markers and note pads.

9. The combination presentation organizer of claim 1 wherein at least one of the graphic viewing portions is made of a rigid material.

* * * * *